US008038359B2

(12) United States Patent
Lee

(10) Patent No.: US 8,038,359 B2
(45) Date of Patent: Oct. 18, 2011

(54) PRINTING MEDIUM SUPPLY DEVICE AND IMAGE FORMING APPARATUS HAVING THE SAME

(75) Inventor: Dong Gyoo Lee, Yongin-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 902 days.

(21) Appl. No.: 11/954,830

(22) Filed: Dec. 12, 2007

(65) Prior Publication Data

US 2008/0199241 A1 Aug. 21, 2008

(30) Foreign Application Priority Data

Feb. 15, 2007 (KR) ..... 10-2007-0016016

(51) Int. Cl.
*B65H 1/04* (2006.01)

(52) U.S. Cl. ..... 400/624; 271/145; 271/171

(58) Field of Classification Search ..... 400/624; 399/393; 271/169, 170, 145, 171
See application file for complete search history.

(56) References Cited

U.S. PATENT DOCUMENTS 4,030,725 A * 6/1977 Fukui et al. ..... 271/164
6,022,016 A * 2/2000 Cheong ..... 271/170

FOREIGN PATENT DOCUMENTS

JP 01192650 A * 8/1989
JP 02193833 A * 7/1990
JP 06144600 A * 5/1994
JP 2004155585 A * 6/2004
JP 2005343667 A * 12/2005
KR 10-255642 2/2000

* cited by examiner

*Primary Examiner* — Daniel J Colilla
(74) *Attorney, Agent, or Firm* — Stanzione & Kim LLP

(57) ABSTRACT

An image forming apparatus including an image forming apparatus body, a printing engine installed in the image forming apparatus body and used to print an image on a printing medium supplied to the printing engine, a printing medium supply device having a loading plate to load printing media thereon and a frame to support the loading plate, the printing medium supply device being coupled to the image forming apparatus body to supply the printing media to the printing engine, and a pickup device to pick up the printing media loaded in the printing medium supply device one by one and to convey each picked-up printing medium to the printing engine. The printing medium supply device includes a printing medium aligning unit to push a lateral portion of the printing media when the printing media is loaded on the loading plate, so as to align the loaded printing media. With this configuration, the printing media loaded on the loading plate is automatically aligned by the printing medium aligning unit.

28 Claims, 5 Drawing Sheets

PRINTING MEDIUM SUPPLY DEVICE AND IMAGE FORMING APPARATUS HAVING THE SAME

BACKGROUND OF THE INVENTION

1. Field of the Invention

The present general inventive concept relates to an image forming apparatus, and, more particularly, to a printing medium supply device capable of sequentially supplying printing media for the implementation of a sequential printing operation, and an image forming apparatus having the printing medium supply device.

2. Description of the Related Art

Generally, an image forming apparatus is an apparatus to develop a black-and-white image or color image on a printing medium, such as a sheet of paper, on the basis of an image signal. Examples of the image forming apparatus include a laser printer, an ink-jet printer, a copying machine, a multi-function machine, facsimile, etc. Representative image forming methods of these various kinds of image forming apparatuses include an electro-photographic method and an ink-jet method. In the electro-photographic method, a light beam is scanned onto a photosensitive member so as to form an electrostatic latent image, and a toner is attached onto the electrostatic latent image to transfer the electrostatic latent image onto a printing medium. In the ink-jet method, liquid-phase ink is ejected onto a surface of a printing medium on the basis of an image signal.

The above mentioned image forming apparatuses commonly comprise a printing medium supply device for storing a plurality of printing media therein and sequentially supplying the printing media for the implementation of a sequential printing operation. The printing medium supply device is detachably coupled to the bottom of an image forming apparatus body, and is used to supply the printing medium to an electro-photographic or ink-jet type printing engine that is installed in the image forming apparatus body. The printing medium supply device includes a frame coupled to the image forming apparatus body, and a loading plate installed in the frame and used to load the printing medium thereon. The loading plate serves to lift the printing medium, loaded thereon, toward a pickup device that is also installed in the image forming apparatus body.

When a printing operation begins, the pickup device picks up the printing medium, loaded on the loading plate, one by one, and conveys the picked-up printing medium to the printing engine. However, if the printing medium loaded on the loading plate has an incorrect alignment when being picked up by the pickup device, it may cause certain errors, for example, skew, a double pick-up, and/or a jam of the printing medium.

To solve the above problem, the loading plate is provided with a printing medium guide for the alignment of the printing medium. The printing medium guide is installed on the loading plate such that it can be manually moved by the user's operation. After loading of the printing medium, the user is able to align the loaded printing medium by moving the printing medium guide.

However, the above described conventional printing medium supply device is troublesome in use because the user has to operate the printing medium guide every time after loading the printing medium. If the user carelessly forgets to operate the printing medium guide after loading the printing medium, the loaded printing medium could be incorrectly aligned, thus causing certain errors, for example, a skew, a double pick-up, and/or a jam of the printing medium. These errors, caused during the conveyance of the printing medium, may result in deterioration in printing quality, waste of the printing medium, and malfunction of the image forming apparatus.

SUMMARY OF THE INVENTION

The present general inventive concept provides a printing medium supply device in which a printing medium can be automatically aligned on a loading plate in the course of being loaded on the loading plate, and an image forming apparatus having the printing medium supply device.

Additional aspects and utilities of the present general inventive concept will be set forth in part in the description which follows and, in part, will be obvious from the description, or may be learned by practice of the invention.

The foregoing and/or other aspects and utilities of the present general inventive concept can be achieved by providing an image forming apparatus including: an image forming apparatus body; a printing engine installed in the image forming apparatus body and used to print an image on a printing medium supplied to the printing engine; a printing medium supply device having a loading plate to load printing media thereon, and a frame to support the loading plate and a printing medium aligning unit to push a lateral portion of the printing media when the printing media is loaded on the loading plate, so as to align the loaded printing media, the printing medium supply device being coupled to the image forming apparatus body to supply the printing media to the printing engine; and a pickup device to pick up the printing media loaded in the printing medium supply device one by one and to convey each picked-up printing medium to the printing engine, wherein the printing medium aligning unit includes a first lever, and the first lever includes a first arm to be pushed by a first side portion of the loaded printing media, a second arm operatively connected to the first arm so as to push a second side portion of the loaded printing media and a first hinge to rotatably support the first and second arms for the operative connection of the first and second arms.

The printing medium aligning unit may include a first lever, and the first lever may include a first arm to be pushed by a first side portion of the loaded printing media, a second arm operatively connected to the first arm so as to push a second side portion of the loaded printing media, and a first hinge to rotatably support the first and second arms for the operative connection of the first and second arms.

The first arm may be coupled to a first operating member having a first inclined surface, which has a predetermined inclination with the loading plate such that the first inclined surface comes into contact with the first side portion of the loaded printing media, and the first operating member may be pushed together with the first arm when the first side portion of the loaded printing media is placed on the first inclined surface.

An operating spring may be installed between the first arm and the first operating member.

The printing medium supply device may include a printing medium separating wall, which has a predetermined inclination with the loading plate such that the printing medium separating wall comes into contact with the first side portion of the loaded printing media for individually separating the printing media to be picked up by the pickup device, and the printing medium separating wall may be supported on the frame by a supporting spring such that the printing medium separating wall is pushed, together with the first operating member, by the loaded printing media.

The second arm may be coupled to a first pressure member having a first pressure surface to come into contact with the second side portion of the loaded printing media.

A pressure spring may be installed between the second arm and the first pressure member.

The printing medium aligning unit may include a second lever hingedly coupled to have the same rotating center as the rotating center of the first lever such that the second lever is operable by a smaller pressure force than the first lever, and the second lever may include a third arm to be pushed by a first side portion of the loaded printing medium, a fourth arm operatively connected to the third arm so as to push a second side portion of the loaded printing media, and a second hinge to rotatably support the third and fourth arms for the operative connection of the third and fourth arms.

The third arm may be coupled to a second operating member having a second inclined surface, which has a predetermined inclination with the loading plate such that the second inclined surfaces comes into contact with the first side portion of the loaded printing media, and the second operating member may be pushed together with the third arm when the first side portion of the loaded printing media is placed on the second inclined surface.

The fourth arm may be coupled to a second pressure member having a second pressure surface to come into contact with the second side portion of the loaded printing media.

The loading plate may be provided with a printing medium guide, which is movably installed to push a lateral portion of the loaded printing medium for aligning the loaded printing media, and the first lever may be hingedly coupled to a guide frame that is coupled to the printing medium guide.

The guide frame may have a hinge shaft, and the first hinge is rotatably coupled to the hinge shaft.

The foregoing and/or other aspects and utilities of the present general inventive concept can also be achieved by providing a printing medium supply device for an image forming apparatus including: a loading plate, on which printing media is loaded; a frame to support the loading plate; and a printing medium aligning unit to push a lateral portion of the printing media when the printing media is loaded on the loading plate, so as to align the loaded printing media, wherein the printing medium aligning unit includes a first lever, and the first lever includes a first arm to be pushed by a first side portion of the loaded printing medial, a second arm operatively connected to the first arm so as to push a second side portion of the loaded printing media, and a first hinge to rotatably support the first and second arms for the operative connection of the first and second arms.

The foregoing and/or other aspects and utilities of the present general inventive concept can also be achieved by providing an image forming apparatus, comprising: a printing medium supply device to store printing media thereon, and including: a loading plate to raise the printing media toward a pickup unit to pick up an uppermost printing medium, and a printing medium aligning unit including a first portion to align a first side of the printing media by applying a first predetermined range of pressure thereto proportional to a first weight range of the printing media applied to the first portion by a second side of the printing media, and a second portion to align the first side of the printing media by applying a second predetermined range of pressure thereto proportional to a second weight range of the printing media by the second side of the printing media.

The first portion of the printing medium aligning unit may include a first lever including a first arm to be pressed by the weight from the second side of the loaded printing media, a second arm rotatably connected to the first arm to apply the pressure to the first side of the loaded printing media, and a first hinge to rotatably connect the first and second arms with respect to each other.

The second portion of the printing medium aligning unit may include a second lever including a third arm to be pressed by the weight from the second side of the loaded printing media, a fourth arm rotatably connected to the third arm to apply the pressure to the first side of the loaded printing media, and a second hinge to rotatably connect the third and fourth arms of the second portion with respect to each other, wherein the second portion operates when the loaded printing media in not within the first weight range.

BRIEF DESCRIPTION OF THE DRAWINGS

These and/or other aspects and utilities of the present general inventive concept will become apparent and more readily appreciated from the following description of the embodiments, taken in conjunction with the accompanying drawings, of which.

DETAILED DESCRIPTION OF THE PREFERRED EMBODIMENTS

Figure 1:
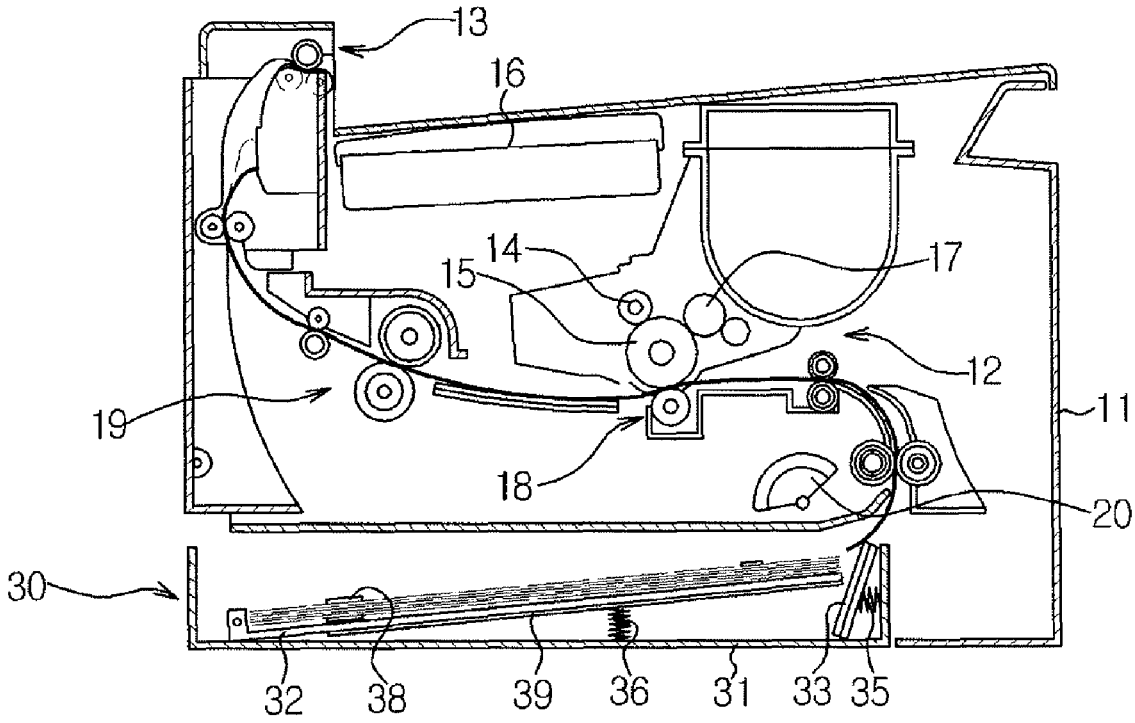
FIG. 1 is a side sectional view schematically illustrating an image forming apparatus in accordance with an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

As illustrated in FIG. 1, the image forming apparatus in accordance an embodiment of the present general inventive concept is a laser printer in which a developing agent is attached to a photosensitive member 15 formed with an electrostatic latent image, to form a visible image, and the visible image is transferred onto a printing medium.

The image forming apparatus in accordance with the present embodiment includes a body 11 defining the outer appearance of the image forming apparatus, a printing engine 12 to print an image on a printing medium supplied thereto, a printing medium supply device 30 detachably coupled to the image forming apparatus body 11 to supply a printing medium, and a pickup device 20 to pick up the printing medium, loaded in the printing medium supply device 30, one by one and to convey the printing medium to the printing engine 12.

In the image forming apparatus in accordance with the present embodiment, if a printing operation begins, the pickup device 20 is operated to pick up the printing medium, loaded in the printing medium supply device 30, one by one, and to convey the printing medium to the printing engine 12. The picked-up printing medium is conveyed to a printing medium discharge region 13 by rollers installed in the image forming apparatus body 11 on a conveyance path of the printing medium.

While the printing medium is conveyed to the printing medium discharge region 13, a laser beam, scanned from a laser scanning unit 16, is introduced on the basis of an image signal onto a surface of the photosensitive member 15 that was electrically charged with a predetermined electric potential by an electric charger 14, so as to form an electrostatic latent image. Then, as toner particles are attached to the electrostatic latent image on the surface of the photosensitive member 15 by a developing roller 17, a visible image of powder is formed on the surface of the photosensitive member 15. The formed visible image is transferred onto a surface of the printing medium by a transfer device 18. Thereafter, the visible image, transferred onto the printing medium, is fixed onto the surface of the printing medium as it is molten upon receiving a pressure and heat while the printing medium passes through a fixing device 19. The printing medium, having passed through the fixing device 19, is discharged to the outside of the image forming apparatus body 11 through the printing medium discharge region 13.

To perform the above described serial printing procedure, a plurality of printing media is loaded in the printing medium supply device 30.

Figure 2:
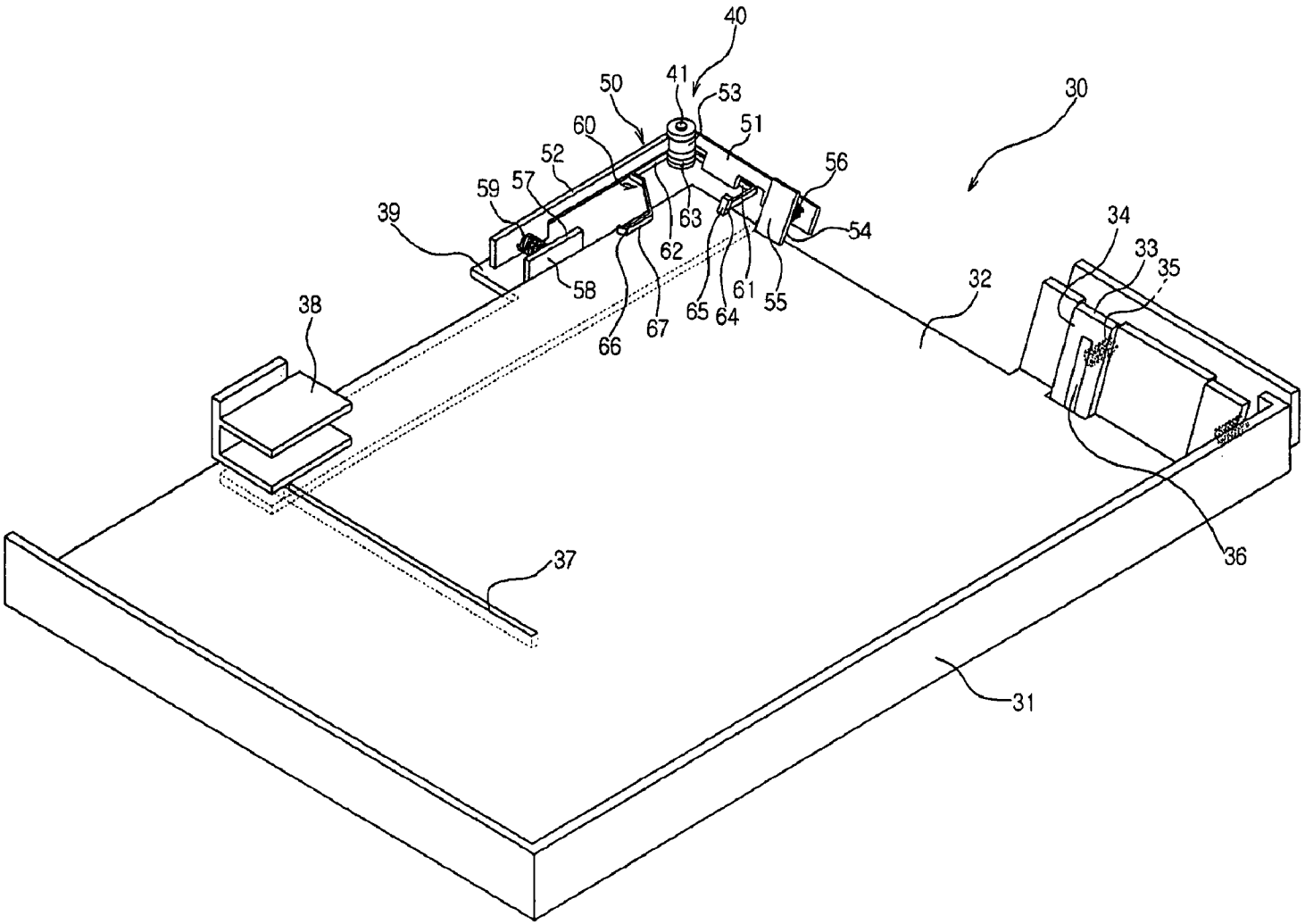
FIGS. 2 and 3 are perspective views schematically illustrating a printing medium supply device of the image forming apparatus of FIG. 1, in accordance with an embodiment of the present general inventive concept.

The printing medium supply device 30, as illustrated in FIGS. 1 and 2, includes a frame 31 coupled to the image forming apparatus body 11, a loading plate 32 installed within the frame 31 to load a plurality of printing media thereon, and a printing medium aligning unit 40 to align the printing media loaded on the loading plate 32.

The frame 31 is provided with at least one printing medium separating wall 33, to separate the printing media individually when the printing media, loaded on the loading plate 32, is picked up by the pickup device 20 one by one. The printing medium separating wall 33 is supported by a supporting spring 35 coupled to the frame 31. The printing medium separating wall 33 has an inclined separating surface 34, which has a predetermined inclination with the loading plate 32 such that it comes into contact a front side portion of printing media when the printing media is loaded on the loading plate 32. The inclined separating surface 34 has a frictional portion 36 to increase a frictional force with the printing media. As the inclined separating surface 34 is pressed by the front side portion of the printing media in the course of loading the printing media on the loading plate 32, the supporting spring 35 is compressed, and the printing medium separating wall 33 is pushed slightly.

The loading plate 32 has a rear end hingedly coupled to the frame 31, and an upper end to be lifted toward the pickup device 20 by a lifting spring 36 installed on the frame 31. The loading plate 32 is formed, at a position of an upper surface thereof, with a sliding slot 37 having a predetermined length. A printing medium guide 38 is fitted into the sliding slot 37 and is used to press a lateral portion of the loaded printing media so as to align the printing media on the loading plate 32. The printing medium guide 38 is manually slidingly moved by the user's operation. A guide frame 39 is installed below the printing medium guide 38 such that it comes into contact with a lower surface of the loading plate 32. The guide frame 39 is movable together with the printing medium guide 38 during the sliding movement of the printing medium guide 38.

Figure 3:
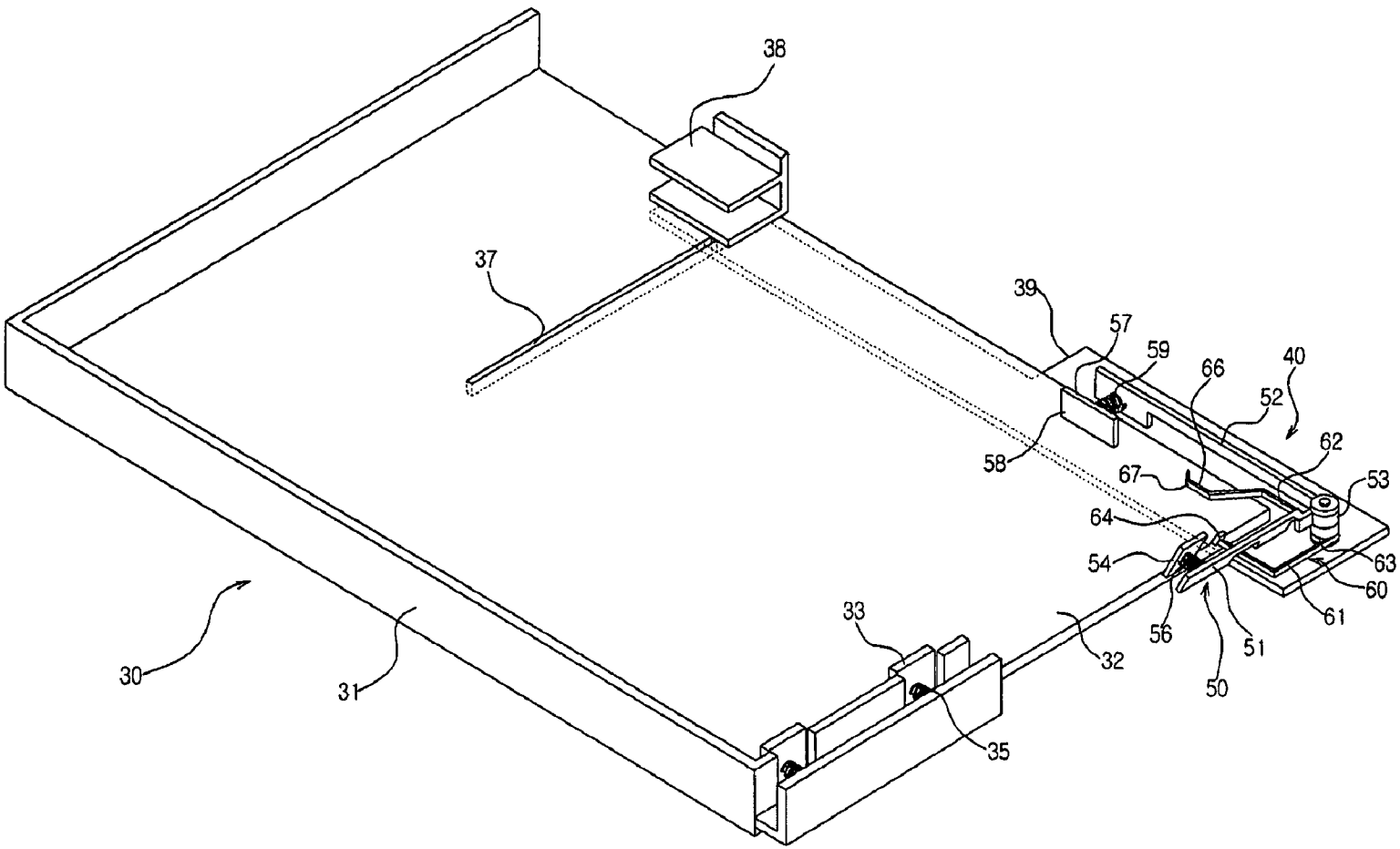

The printing medium aligning unit 40, as illustrated in FIGS. 2 and 3, is installed on the guide frame 39 and is used to automatically align the printing media loaded on the loading plate 32. The printing medium aligning unit 40 includes first and second levers 50 and 60, which are rotatably installed at a hinge shaft 41 installed at a position of the guide frame 39.

The first lever 50 includes a first arm 51 disposed approximately parallel to a front side portion of the loaded printing media, a second arm 52 disposed approximately parallel to a lateral portion of the loaded printing media, the second arm 52 being approximately perpendicular to the first arm 51, and a first hinge 53 rotatably coupled to the hinge shaft 41 and used to support the first and second arms 51 and 52 and to operatively connect the first and second arms 51 and 52. When the first arm 51 is pushed by the front side portion of the loaded printing media, the second arm 52, which is operatively connected to the first arm 51, acts to push the lateral portion of the loaded printing media.

The first arm 51 is coupled to a first operating member 54 having a first inclined surface 55, which has a predetermined inclination with the loading plate 32 such that it comes into contact with the front side portion of the loaded printing media. The first inclined surface 55 has approximately the same inclination as that of the inclined separating surface 34 of the printing medium separating wall 33. An operating spring 56 is installed between the first operating member 54 and the first arm 51, to support the first operating member 54. If the first operating member 54 is pushed by the weight of the loaded printing media, the operating spring 56 is compressed, and the first arm 51 is rotated about the hinge shaft 41. Then, when the number of the printing media, placed on the first operating member 54, is reduced via the pickup operation of the printing media, the weight of the printing media applied to the first operating member 54 is reduced, thus causing the operating spring 56 to be returned to its original position.

The second arm 52 is coupled to a first pressure member 57 having a first pressure surface 58 to come into contact with the lateral side portion of the loaded printing media. The first pressure member 57 is arranged approximately perpendicular to the loading plate 32 and used to push the lateral side portion of the loaded printing media when the second arm 52 is rotated together with the first arm 51, to align the printing media. A pressure spring 59 is installed between the first pressure member 57 and the second arm 52, to support the first pressure member 57. When the second arm 52 is rotated together with the first arm 51 that is operatively connected thereto, the pressure spring 59 pushes the first pressure member 57 while being compressed. Then, when a reduced torque is applied to the second arm 52 as the printing media is picked up and removed, the pressure spring 59 is returned to its original position.

The second lever 60 is rotatably coupled to the hinge shaft 41 that is coupled with the first lever 50 such that it can be operated by a smaller pressure force than the first lever 50. The second lever 60 has a smaller size than that of the first lever 50 and is installed below the first lever 50. The second lever 60 includes a third arm 61 disposed approximately parallel to the front side portion of the loaded printing media, a fourth arm 62 disposed approximately parallel to the lateral side portion of the loaded printing media, the fourth arm 62 being approximately perpendicular to the third arm 61, and a second hinge 63 rotatably coupled to the hinge shaft 41 and used to support the third and fourth arms 61 and 62 to operatively connect the third and fourth arms 61 and 62. The second hinge 63 is slightly loosely coupled to the hinge shaft 41 as compared to the first hinge 53 of the first lever 50.

The third arm 61 is coupled to a second operating member 64 having a second inclined surface 65, which has a predetermined inclination with the loading plate 32 such that it comes into contact with the front side portion of the loaded printing media. The second inclined surface 65 has approximately the same inclination as that of the first inclined surface 55 of the first operating member 54. The fourth arm 62 is provided with a second pressure member 66 having a second pressure surface 67 to come into contact with the lateral side portion of the loaded printing media. The second pressure surface 67 is approximately perpendicular to the loading plate 32. When the front side portion of the printing media is placed on the second inclined surface 65 in the course of being loaded on the loading plate 32, the second operating member 64 is pressed by the weight of the printing media, and the third arm 61 is rotated about the hinge shaft 41. Thereby, as the fourth arm 62, which is operatively connected to the third arm 61, is rotated about the hinge shaft 41, the second pressure member 66 pushes the lateral side portion of the printing media, so as to align the printing media. The second lever 60 is operable by a smaller pressure force than the first lever 50. When the number of the printing media, loaded on the loading plate 32, is less than a predetermined number (for example, ten sheets of printing media), the loaded printing media is aligned by the second lever 60.

Hereinafter, the operation of the printing medium supply device 30 of the image forming apparatus in accordance with the embodiment described above will be described with reference to the accompanying drawings.

Figure 4:
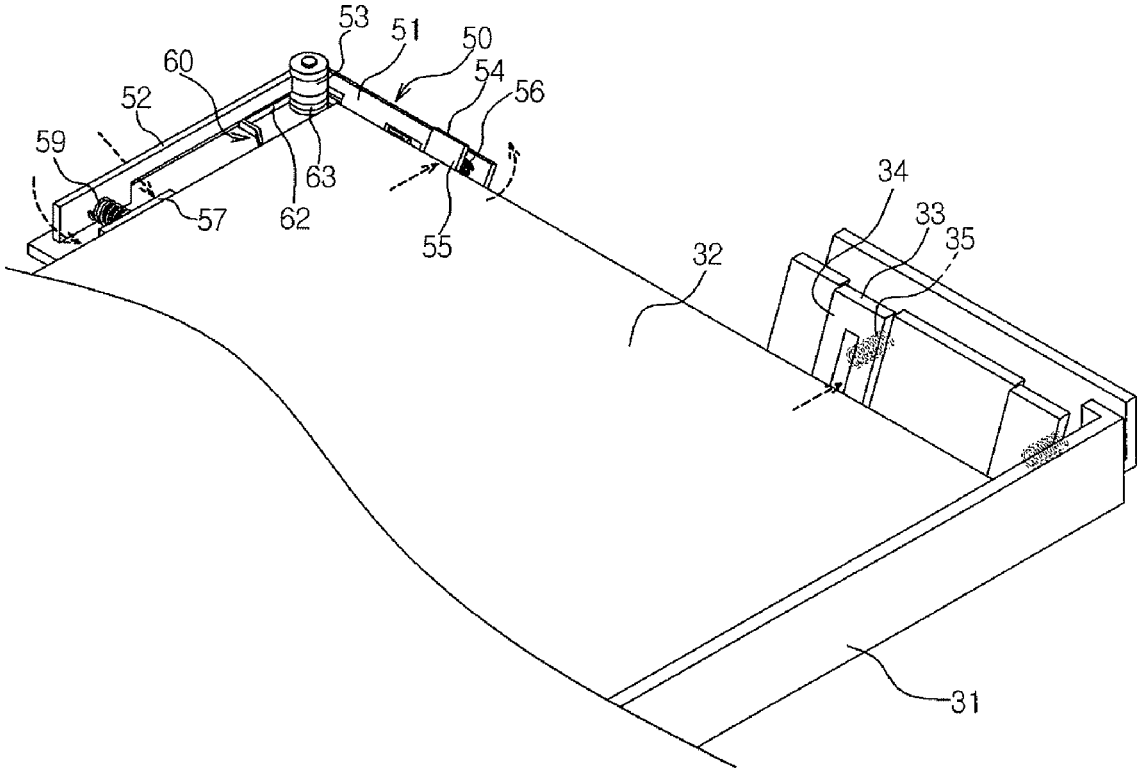
FIGS. 4 and 5 are perspective views illustrating operations of the printing medium supply device of an image forming apparatus, in accordance with an embodiment of the present general inventive concept.

FIG. 4 illustrates a case where more than a predetermined number (for example, more than ten sheets) of printing media is loaded on the loading plate 32.

As illustrated in FIG. 4, when more than a predetermined number of printing media is loaded on the loading plate 32, the front side portion of the loaded printing media is placed on the inclined separating surface 34 of the printing medium separating wall 33, the first inclined surface 55 of the first operating member 54, and the second inclined surface 65 of the second operating member 64. In this case, the inclined separating surface 34 and the first and second inclined surfaces 55 and 65 are pressed by the weight of the loaded printing media. Thereby, the printing medium separating wall 33 and the first and second operating members 54 and 64 are pushed backward, and the supporting spring 35 and the operating spring 56 are compressed.

The first arm 51 of the first lever 50 and the third arm 61 of the second lever 60 are rotated by the pressure force, and simultaneously, the second and fourth arms 52 and 62, which are operatively connected to the first and third arms 51 and 61, are rotated. As the second and fourth arms 52 and 62 are rotated, the pressure spring 59 supporting the first pressure member 57 is compressed, and the first and second pressure members 57 and 66 push the lateral side portion of the loaded printing media, and align the loaded printing media.

If the pickup device (20, See FIG. 1) picks up an uppermost one of the printing media aligned on the loading plate 32, the uppermost printing medium is separated from the remaining printing media in a state wherein the front side portion thereof comes into contact with the printing medium separating wall 33. As the amount of the printing media loaded on the loading plate 32 is reduced via the sequential pick-up operation of the loaded printing media, a reduced pressure force is applied to the inclined surfaces 55 and 65 of the first and second operating members 54 and 64. Thereby, the first lever 50 is returned to its original position as the operating spring 56 and the pressure spring 59 are returned to their original positions. Also, the second lever 60 is returned to its original position as the second pressure member 66 is pushed by a repulsive force from the lateral side portion of the loaded printing media.

Figure 5:
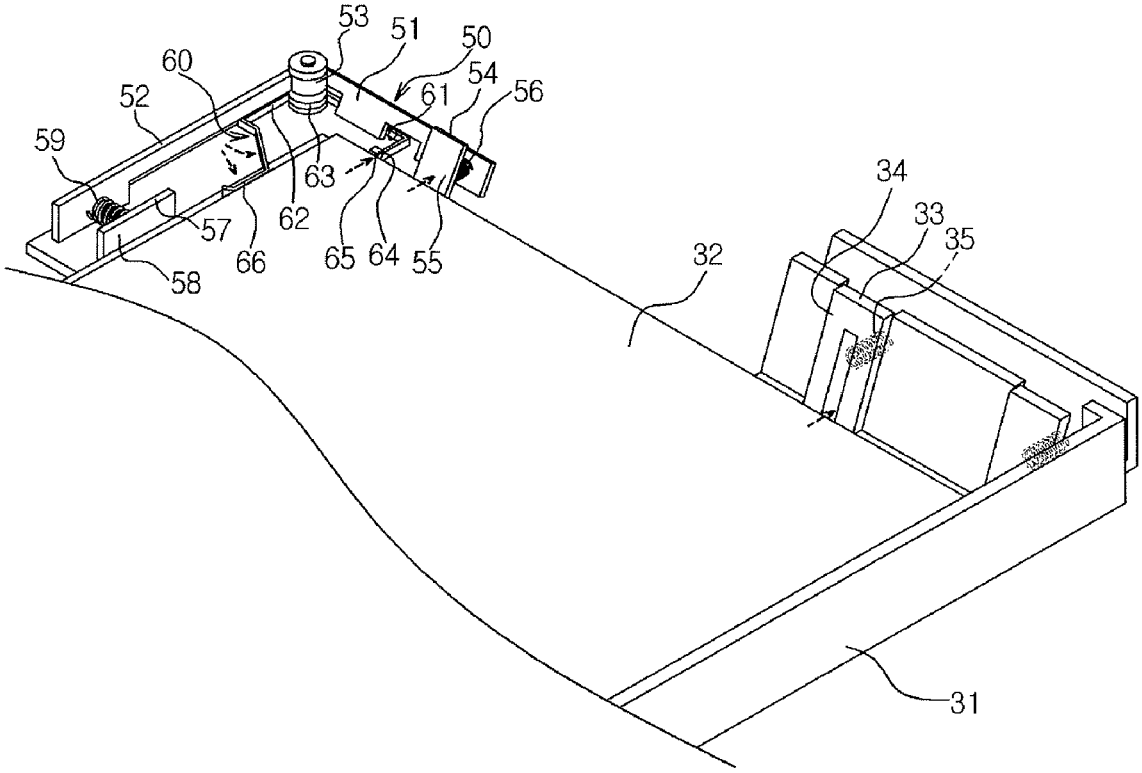

FIG. 5 illustrates a case where less than a predetermined number (for example, less than ten sheets) of printing media is loaded on the loading plate 32.

As illustrated in FIG. 5, when a small amount of printing media is loaded on the loading plate 32, the front side portion of the loaded printing media is placed on the inclined separating surface 34 of the printing medium separating wall 33 and the inclined surfaces 55 and 65 of the first and second operating members 54 and 64. In this case, since the weight of the loaded printing media is small, the first lever 50 is not operated, and only the second operating member 64 of the second lever 60 is pushed backward. Thereby, the third and fourth arms 61 and 62 are rotated, and the second pressure member 66 presses the lateral side portion of the loaded printing media, so as to align the loaded printing media.

When the amount of the printing media loaded on the loading plate 32 is reduced as the pickup device 20 picks up the printing media aligned on the loading plate 32 one by one, a reduced pressure force is applied to the second operating member 64. In this case, a repulsive force caused from the lateral side portion of the loaded printing media is applied to the second pressure member 66, and thus, the second lever 60 is returned to its original position.

Meanwhile, although a laser printer is exemplified as the image forming apparatus of the present general inventive concept in the above description, the present general inventive concept may employ other kinds of image forming apparatuses having the printing medium supply device 30, such as an ink-jet printer, copying machine, multi-function machine, facsimile, etc., as an alternative to the laser printer.

As apparent from the above description, according to the present general inventive concept, printing media loaded on a loading plate can be automatically aligned by a printing medium aligning unit installed at the loading plate. As a result, the present general inventive concept has the effect of reducing the occurrence of errors, for example, a skew, a double pick-up, and/or a jam of the printing media, during the pickup operation of the printing media. Further, the present general inventive concept improves convenience in use because it is unnecessary for a user to manually align the printing media every time after loading of the printing media.

Although a few embodiments of the present general inventive concept have been shown and described, it would be appreciated by those skilled in the art that changes may be made in these embodiments without departing from the principles and spirit of the general inventive concept, the scope of which is defined in the appended claims and their equivalents.

What is claimed is:

1. An image forming apparatus comprising:

an image forming apparatus body;

a printing engine installed in the image forming apparatus body and used to print an image on a printing medium supplied to the printing engine;

a printing medium supply device having a loading plate to load printing media thereon, and a frame to support the loading plate and a printing medium aligning unit to push a lateral portion of the printing media when the printing media is loaded on the loading plate to align the loaded printing media, the printing medium supply device being coupled to the image forming apparatus body to supply the printing media to the printing engine; and a pickup device to pick up the printing media loaded in the printing medium supply device one by one and to convey each picked-up printing medium to the printing engine, wherein the printing medium aligning unit comprises a first lever, and the first lever includes a first arm to be pushed by a first side portion of the loaded printing media, a second arm operatively connected to the first arm to push a second side portion of the loaded printing media in response to movement of the first arm, and a first hinge to rotatably support the first and second arms to operatively connect the first and second arms.

2. The image forming apparatus according to claim 1, wherein:

the first arm is coupled to a first operating member having a first inclined surface, which has a predetermined inclination with the loading plate such that the first inclined surface comes into contact with the first side portion of the loaded printing media; and the first operating member is pushed together with the first arm when the first side portion of the loaded printing media is placed on the first inclined surface.

3. The image forming apparatus according to claim 2, wherein an operating spring is installed between the first arm and the first operating member.

4. The image forming apparatus according to claim 3, wherein:

the printing medium supply device comprises a printing medium separating wall, which has a predetermined inclination with the loading plate such that the printing medium separating wall comes into contact with the first side portion of the loaded printing media to individually separate the printing media to be picked up by the pickup device; and the printing medium separating wall is supported on the frame by a supporting spring such that the printing medium separating wall is pushed, together with the first operating member, by the loaded printing media.

5. The image forming apparatus according to claim 1, wherein the second arm is coupled to a first pressure member having a first pressure surface to come into contact with the second side portion of the loaded printing media.

6. The image forming apparatus according to claim 5, wherein a pressure spring is installed between the second arm and the first pressure member.

7. The image forming apparatus according to claim 1, wherein:

the printing medium aligning unit comprises a second lever hingedly coupled to have the same rotating center as the rotating center of the first lever such that the second lever is operable by a smaller pressure force than the first lever; and the second lever comprises a third arm to be pushed by a first side portion of the loaded printing medium, a fourth arm operatively connected to the third arm to push a second side portion of the loaded printing media, and a second hinge to rotatably support the third and fourth arms to operatively connect the third and fourth arms.

8. The image forming apparatus according to claim 7, wherein:

the third arm is coupled to a second operating member having a second inclined surface, which has a predetermined inclination with the loading plate such that the second inclined surfaces comes into contact with the first side portion of the loaded printing media; and the second operating member is pushed together with the third arm when the first side portion of the loaded printing media is placed on the second inclined surface.

9. The image forming apparatus according to claim 7, wherein the fourth arm is coupled to a second pressure member having a second pressure surface to come into contact with the second side portion of the loaded printing media.

10. The image forming apparatus according to claim 1, wherein:

the loading plate is provided with a printing medium guide, which is movably installed to push a lateral portion of the loaded printing media to align the loaded printing media; and the first lever is hingedly coupled to a guide frame that is coupled to the printing medium guide.

11. The image forming apparatus according to claim 10, wherein the guide frame has a hinge shaft, and the first hinge is rotatably coupled to the hinge shaft.

12. A printing medium supply device usable with an image forming apparatus, comprising:

a loading plate, on which printing media is loaded;

a frame to support the loading plate; and a printing medium aligning unit to push a lateral portion of the printing media when the printing media is loaded on the loading plate, to align the loaded printing media, wherein the printing medium aligning unit comprises a first lever, and the first lever includes a first arm to be pushed by a first side portion of the loaded printing media, a second arm operatively connected to the first arm to push a second side portion of the loaded printing media, in response to movement of the first arm, and a first hinge to rotatably support the first and second arms to operatively connect the first and second arms.

13. The printing medium supply device according to claim 12, wherein:

the first arm is coupled to a first operating member having a first inclined surface, which has a predetermined inclination with the loading plate such that the first inclined surface comes into contact with the first side portion of the loaded printing media; and the first operating member is pushed together with the first arm when the first side portion of the loaded printing media is placed on the first inclined surface.

14. The printing medium supply device according to claim 13, wherein an operating spring is installed between the first arm and the first operating member.

15. The printing medium supply device according to claim 14, wherein:

the printing medium supply device comprises a printing medium separating wall, which has a predetermined inclination with the loading plate such that the printing medium separating wall comes into contact with the first side portion of the loaded printing media to individually separate the printing media to be picked up; and the printing medium separating wall is supported on the frame by a supporting spring such that the printing medium separating wall is pushed, together with the first operating member, by the loaded printing media.

16. The printing medium supply device according to claim 12, wherein the second arm is coupled to a first pressure member having a first pressure surface to come into contact with the second side portion of the loaded printing media.

17. The printing medium supply device according to claim 16, wherein a pressure spring is installed between the second arm and the first pressure member.

18. The printing medium supply device according to claim 12, wherein:

the printing medium aligning unit comprises a second lever hingedly coupled to have the same rotating center as the rotating center of the first lever such that the second lever is operable by a smaller pressure force than the first lever; and the second lever comprises a third arm to be pushed by a first side portion of the loaded printing medium, a fourth arm operatively connected to the third and fourth arms to push a second side portion of the loaded printing medium, and a second hinge to rotatably support the third and fourth arms to operatively connect the third and fourth arms.

19. The printing medium supply device according to claim 18, wherein:

the third arm is coupled to a second operating member having a second inclined surface, which has a predetermined inclination with the loading plate such that the second inclined surfaces comes into contact with the first side portion of the loaded printing media; and the second operating member is pushed together with the third arm when the first side portion of the loaded printing media is placed on the second inclined surface.

20. The printing medium supply device according to claim 18, wherein the fourth arm is coupled to a second pressure member having a second pressure surface to come into contact with the second side portion of the loaded printing media.

21. The printing medium supply device according to claim 12, wherein:

the loading plate is provided with a printing medium guide, which is movably installed to push a lateral portion of the loaded printing medium to align the loaded printing media; and the first lever is hingedly coupled to a guide frame that is coupled to the printing medium guide.

22. The printing medium supply device according to claim 21, wherein the guide frame has a hinge shaft, and the first hinge is rotatably coupled to the hinge shaft.

23. An image forming apparatus, comprising:

a printing medium supply device to store printing media thereon, the printing medium supply device including:

a loading plate to raise the printing media toward a pickup unit to pick up an uppermost printing medium, and a printing medium aligning unit including a first portion to align a first side of the printing media by applying a first predetermined range of pressure thereto proportional to a first weight range of the printing media applied to the first portion by a second side of the printing media, and a second portion to align the first side of the printing media by applying a second predetermined range of pressure thereto proportional to a second weight range of the printing media by the second side of the printing media.

24. The image forming apparatus according to claim 23, wherein the first portion of the printing medium aligning unit comprises:

a first lever including a first arm to be pressed by the weight from the second side of the loaded printing media, a second arm rotatably connected to the first arm to apply the pressure to the first side of the loaded printing media, and a first hinge to rotatably connect the first and second arms with respect to each other.

25. The image forming apparatus according to claim 24, wherein the second portion of the printing medium aligning unit comprises:

a second lever including a third arm to be pressed by the weight from the second side of the loaded printing media, a fourth arm rotatably connected to the third arm to apply the pressure to the first side of the loaded printing media, and a second hinge to rotatably connect the third and fourth arms of the second portion with respect to each other, wherein the second portion operates when the loaded printing media in not within the first weight range.

26. A print medium containing unit, comprising:

a floor portion;

a plurality of side portions, the floor portion and side portions containing one or more pieces of a print media, the print media having a first edge and a second edge;

a shaft; and a first lever, the first lever including a first arm and a second arm, the first and second arms rotatably connected to one another about the shaft, the second arm including a first pressure member and the first arm including a first operating member with an inclined surface respective to the floor portion of the print medium containing unit receiving a first pushing force from the one or more print media at a first edge, whereupon the rotatably connected second arm transmits a second pushing force to the second edge of the one or more print media in response to the received pushing force.

27. The print medium containing unit according to claim 26, further comprising:

a second lever, the second lever including a third arm and a fourth arm, the third and fourth arms rotatably connected to one another about the shaft, the fourth arm including a second pressure member and the third arm including a first operating member with an inclined surface respective to the floor portion of the print medium containing unit receiving a third pushing force from the one or more print media at a first edge, whereupon the rotatably connected fourth arm transmits a fourth pushing force to the second edge of the one or more print media in response to the received pushing force.

28. The print medium containing unit according to claim 27, wherein the first lever rotates upon receipt of the first pushing force that is greater than the third pushing force.

* * * * *